United States Patent [19]

Schoenrock et al.

[11] 3,973,986

[45] Aug. 10, 1976

[54] PROCESS FOR THE PURIFICATION OF SUGARBEET JUICE AND INCREASING THE EXTRACTION OF SUGAR THEREFROM

[75] Inventors: Karlheinz W. R. Schoenrock; Hugh G. Rounds, both of Ogden, Utah

[73] Assignee: The Amalgamated Sugar Company, Ogden, Utah

[22] Filed: Mar. 26, 1975

[21] Appl. No.: 562,006

[52] U.S. Cl. ..... 127/46 A; 210/30 R

[51] Int. Cl.[2] ..... C13D 3/14

[58] Field of Search ..... 127/46 A

[56] References Cited

UNITED STATES PATENTS

| | | | |
|---|---|---|---|
| 2,560,504 | 7/1951 | Day | 127/46 A |
| 3,887,391 | 6/1975 | Schoenrock | 127/46 A |

FOREIGN PATENTS OR APPLICATIONS

| | | |
|---|---|---|
| 768,278 | 2/1957 | United Kingdom |

OTHER PUBLICATIONS

Sugar Industry Abstracts, vol. 23, Abs. 931 (1961).

Sugar Industry Abstracts, vol. 23, Abs. 932 (1961).

*Primary Examiner*—Morris O. Wolk

*Assistant Examiner*—Sidney Marantz

*Attorney, Agent, or Firm*—Pierce, Scheffler & Parker

[57] ABSTRACT

An increase in the recovery of sugar from a syrup obtained from sugarbeet juice is realized by treating the clarified juice with a cationic exchanger in the ammonium form followed by displacement of the ammonium ions by means of magnesium oxide or magnesium hydroxide.

2 Claims, 2 Drawing Figures

Figure 1:
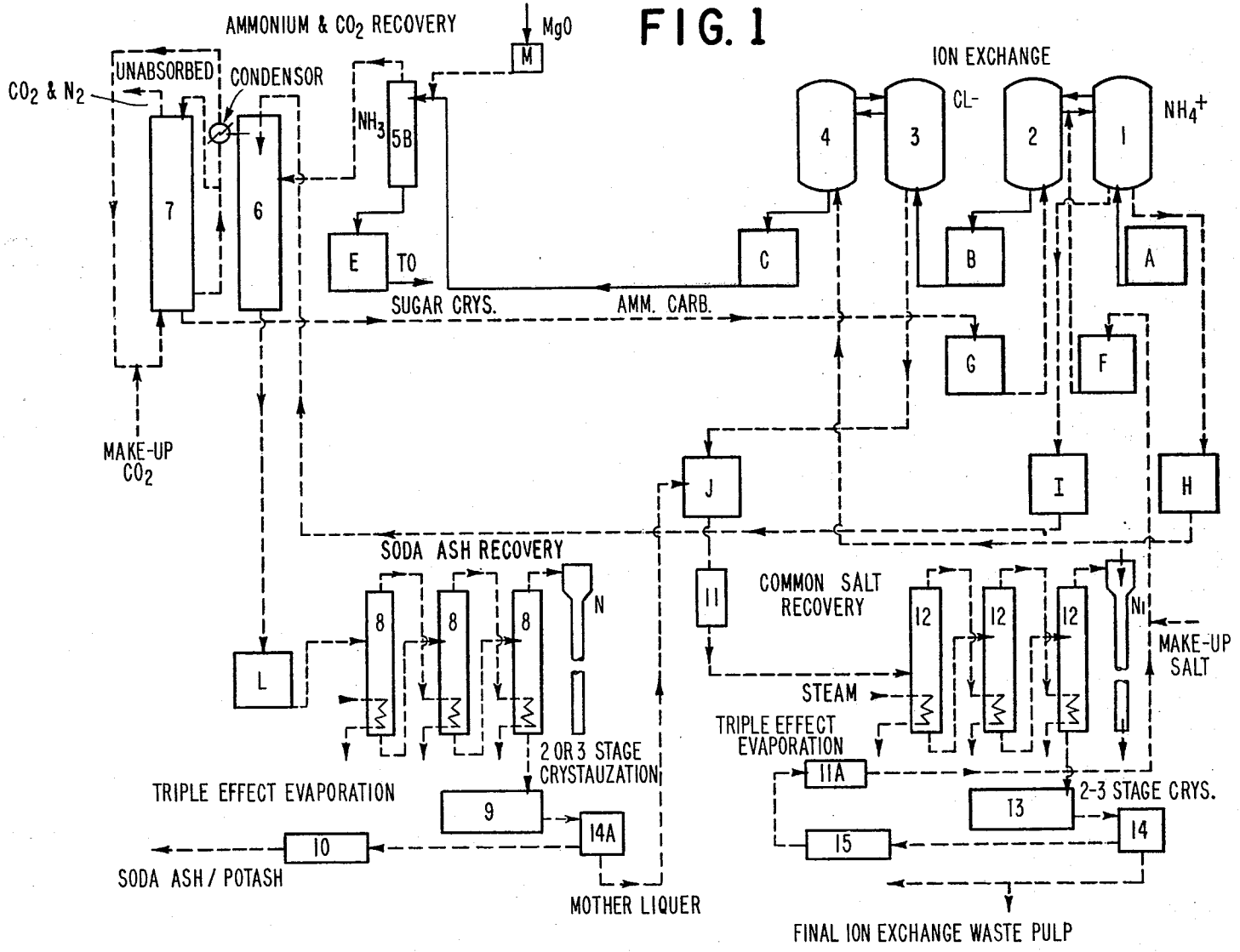

PROCESS FOR THE PURIFICATION OF SUGARBEET JUICE AND INCREASING THE EXTRACTION OF SUGAR THEREFROM

The present invention relates to the recovery of sugar from a juice containing the same, and is particularly concerned with procedures for purifying such sugar-containing juice prior to crystallization. The process of the invention may be applied in the processing of cane juice as well as beet juice.

The purification of sugarbeet juice and the efficient extraction of crystallized sugar therefrom are, to a large degree, determined by the cationic constituents therein. The conventional purification of the sugarbeet juice proceeds through the addition of lime and carbon dioxide to remove between 10–40% of the so-called nonsugar components. The pH of the beet juice rises from about 6.5 to about 9.2 through this purification process, which is indicative of the removal of acidic components. However, the native monovalent cations, potassium and sodium, are not removed by the conventional lime/carbon dioxide purification process.

Frequently, certain sugarbeets have insufficient natural alkalinity where the conventional lime/$CO_2$ purification process has inadequate capacity to remove sufficient acidic components from the sugarbeet juice through precipitation or absorption on calcium carbonate crystals.

These anions tend to form calcium salts with the lime added during the purification process, which calcium salts cause severe scaling on heating surfaces and substantial increases in the fuel and energy consumption. Alkaline soda compounds such as soda ash or caustic soda are usually added to such sugarbeet juice to enrich it with monovalent cations and to force precipitation of the calcium ion in the form of calcium carbonate prior to the concentration of such juice.

Other so-called softening processes remove calcium ions by ion exchange with a sulfonic-type cation exchanger in the sodium form. Hence, this technique also increases the concentration of monovalent cations in the juice so treated.

It is also general knowledge that the monovalent cations potassium and sodium inhibit the crystallization of sucrose from sugarbeet juice, thereby limiting extraction of sugar from such juice.

A process has now been discovered which allows an efficient exchange, either partially or completely, of all alkali ions in the sugarbeet juice against magnesium ions which have a salting out effect upon sucrose, thereby increasing extraction of sugar. The application of this process in the processing of sugarbeets for the extraction of sugar increases the yield by more than 10%, if properly carried out.

The outstanding novelty of the process is actually expressed in the appended claims and in short involves the indirect exchange of most juice cations against magnesium ions by exchanging first against ammonium ions, followed by displacing the ammonium ion with magnesium oxide or hydroxide respectively. Hence, the process takes advantage of the salting out effect of magnesium ions upon sucrose thereby significantly increasing extraction.

Our process is executed by first treating a clarified sugarbeet juice with a cation exchanger in nthe ammonium form according to formula I:

$$\text{Catex}-NH_4+\text{Sug/Cat}-\text{An} \rightarrow \text{Catex}-\text{Cat}+\text{Sug/}NH_4-\text{An} \quad (I)$$

where

Catex signifies the matrix for cation exchange resin with either sulfonic or carboxylic functional groups;

An signifies a variety of sugarbeet juice anions of either ineorganic or organic nature;

Cat signifies the cations of the sugarbeet juice but predominantly potassium and sodium; and Sug signifies the sugar contained in the sugarbeet juice.

The sugarbeet juice according to formula I is further treated with magnesium oxide or magnesium hydroxide to displace the ammonium ions in the juice according to formula II.

$$\text{Sug}/(NH_4)_2-\text{An}+MgO \rightarrow \text{Sug}/Mg-\text{An}+2NH_3+\lambda H_2O \quad (II)$$

No precise stoichiometric relations are intended between formula "I" and "II" above. All forms of anion valences exist in impure beet sugar juice. For reasons of simplicity, applicants have selected to demonstrate a valence of 1 in formula I and a valence of 2 in formula II. Both are correct and must not be construed to exclude other valences respectively.

The treatment according to formula II proceeds at an elevated temperature of from 40° to 130° C. and can be carried out under a wire range of pressures for the purpose of recovering the displaced ammonia after which the treated juice may be subjected to the conventional crystallization steps.

An additional treatment of the cation-exchanged syrup, such as decolorization and anion exchange over a bicarbonate exchanger, may be carried out ahead of the magnesium oxide treatment. Other novelties of applicants' invention involve the efficient recovery of chemicals required for the operation of this process, as well as the production of alkali metal carbonates extracted from the sugar juice, hence eliminating environmental contamination.

Ammonia liberated according to formula II may be recovered from the vapors for reuse by reconversion, in an absorber, to ammonium carbonate or ammonium bicarbonate, or, to a mixture of these compounds in any combination, by reacting with carbon dioxide according to formula III or IV:

$$2NH_3+CO_2+H_2O \rightarrow (NH_4)_2\,CO_3 \quad (III)$$

$$NH_3+CO_2+H_2O \rightarrow NH_4H\,CO_3 \quad (IV)$$

The products of these reactions are utilized to regenerate the exhausted cation exchanger from formula I according to formula V and formula VI:

$$\text{Catex}-\text{Cat}+2(NH_4)_2CO_3 \rightarrow \text{Catex}-(NH_4)_2+\text{Cat}\,CO_3+(NH_4)_2CO_3 \quad (V)$$

$$\text{Catex}-\text{Cat}+2NH_4HCO_3 \rightarrow \text{Catex}-NH_4H+NH_4H\text{-}CO_3+\text{Cat}-HCO_3 \quad (VI)$$

A stoichiometric excess of about 200% on the exchange capacity of the cation exchanger is normally applied to achieve nearly complete conversion of the cation exchanger to the ammonium form.

Excess ammonium carbonate/ammonium bicarbonate is recovered from the regeneration waste and rinse through distillation in a stripper according to formula VII and/or formula VIII:

$$Cat{-}CO_3+(NH_4)_2CO_3 \rightarrow CatCO_3+2NH_3+CO_2+\lambda H_2O \quad (VII)$$

$$Cat{-}HCO_3+NH_4HCO_3 \rightarrow Cat{-}HCO_3+NH_3+CO_2+H_2O \quad (VIII)$$

The ammonia-containing vapors from the juice evaporation, according to formula II hereinabove, may be utilized to operate the stripper in furnishing the required energy. The condensed and cooled vapors from the stripper are taken to the absorber to be reconverted to the proper concentration and quantity of ammonium carbonate/ammonium bicarbonate respectively, according to formulas III and IV, to maintain the process.

The ammonia-free bottom product from the stripper, which contains the sugarbeet juice cations in the carbonate and bicarbonate form, can be processed through evaporation and crystallization to yield sodium and potassium carbonate respectively or their respective bicarbonates in a relatively pure form.

Figure 2:
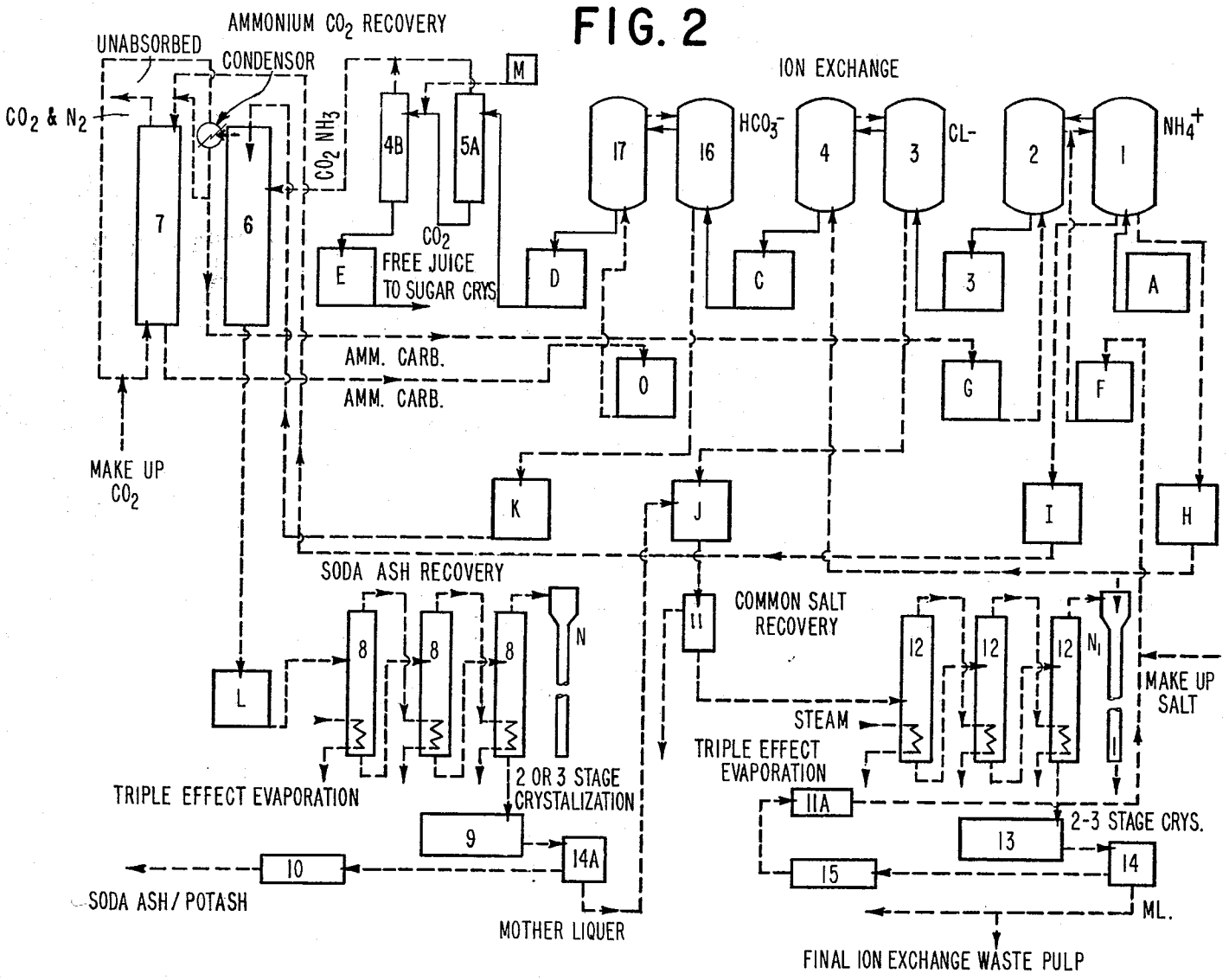

The invention will now be disclosed with greater particularity and with reference to the appended drawing, in which FIG. 1 is a schematic flow sheet of the process of the invention illustrating the cation exchange followed by optional succeeding steps; and FIG. 2 is a similar flow sheet adding, to the showing in FIG. 1, illustration of anion exchange over the bicarbonate form of the exchanger.

FIG. 1 is a schematic process diagram for this invention, which incorporates the cation exchange followed by an optional conventional decolorization and displacement of exchanged ammonium cations in the juice with active magnesium oxide; stripping with a salt solution that part of the cation exchanger loaded with calcium ions taken out of the sugar juice, and using this stripping solution thereafter to regenerate the decolorizer; recovering from the final waste the alkali metal chlorides, through crystallization after removal of the calcium ions and reusing the crystallized chloride salts essentially free of calcium for the stripping of the calcium ions from the cation exchanger; regenerating the cation exchanger after the salt stripping, being essentially free of calcium ions, with an excess of concentrated ammonium carbonate; recovering excess ammonium carbonate from the cation regenerant through distillation and the carbonate of sodium and potassium, respectively, from the bottoms of the distillation through multiple concentration and crystallization where the vapors from the magnesium oxide treated juice are used to furnish the energy to operate the distillation and where the vapors from the distillation are cooled, condensed and thereafter carbonated in an absorber to the desired concentration for re-use in the re-generation of the cation exchanger of the ammonium form. The final mother liquor from the crystallization of the alkali metal carbonates is combined with the decolorizer regenerant to precipitate calcium ions as carbonates prior to the crystallization of the alkali metal chlorides as outlined above.

FIG. 2 incorporates all the features illustrated in FIG. 1, plus the anion exchange over the bicarbonate form of the strong quaternary amine anion exchanger; conversion of the cations in the regeneration effluent from the cation exchanger to the bicarbonate form through carbonation in an absorber and the use of this bicarbonate solution for the regeneration of the anion exchanger; recovering excess ammonium carbonate from the anion regenerant through distillation where the vapors are cooled, condensed and used to regenerate the cation exchanger after its respective salt stripping and being free of calcium ions and where the bottoms from the distillation are subjected to concentration and crystallization for the recovery of sodium and potassium carbonates and other treatments as outlined above.

In the following the flow pattern according to FIG. 1 shall be explained in more detail. The sugar juice containing the impurities to be removed enters the primary vessel 1 of the cation exchanger which being in the regenerated ammonium form will remove the juice cations against ammonium ions being furthermore selective towards the divalent cations. After passing through the primary cation exchanger, being freed entirely of its multivalent cations, the juice will pass through the secondary vessel 2 of the cation exchanger which being in the regenerated ammonium form will remove residual juice cations not exchanged in the primary vessel. The flow of juice through the cation exchanger vessels, connected in series, will continue until either excessive leakage of multivalent juice cations appear in the discharge of the primary cation exchanger vessel or an undesirable leakage of juice cations appear in the discharge of the secondary cation exchanger vessel. The sugar juice now containing nearly all of its cations as ammonium ions is taken to a conventional decolorizer predominantly in the chloride form. Juice flow through the decolorizer 3 and 4 is continued until an excessive leakage of undesirable impurities appear in the effluent. After respective loading of the cation exchanger, the sugar juice is displaced with water — a procedure commonly called sweet-off. The primary cation exchanger is next treated counter current to the juice flow with a 10–15% salt brine solution, being substantially free of calcium ions (less than 0.005 equivalent calcium ion per liter) at a rate of about 200% salt equivalents on the exchange capacity of the cation exchanger, and at a flow rate of about 2 bedvolumes per hour. The brine effluent from the primary cation exchanger is secondarily used to regenerate the decolorizer counter-current to the juice flow after its respective exhaustion and sweetening-off cycle, at a flow rate of about 2–4 bedvolumes per hour and at a total stoichiometric throughput of about 500% chloride ions on the exchange capacity of the decolorizer, thus preparing the decolorizer for the next cycle. The stripping of the primary cation exchanger 1 is immediately followed, save for a small water zone between the salt solution and the following ammonium carbonate solution, with a concentrated solution of ammonium carbonate until about 200% stoichiometric excess on the capacity of the cation exchanger has passed through the exchanger and at a flow rate of about 2 bedvolumes per hour. The flow of the ammonium carbonate cation regenerant will pass counter-current to the juice flow through the exchanger entering first the secondary cation exchanger vessel 2, and thereafter the primary cation exchanger vessel 1.

The treated sugar juice having passed through the cation exchanger and the decolorizer respectively is next treated with an amount of magnesium oxide which is slightly in a stoichiometric excess over the ammonium ion concentration in the juice and heated in an evaporator 5 to expel the ammonium ions from the juice. The vapors from this evaporation, containing the exchanged ammonium ions from the sugar juice, are used to supply the energy required to operate a distillation tower 6 for expelling excess ammonium carbonate from the used cation exchanger regenerant. The vapors from the distillation towers 6 are cooled, condensed and taken to an absorber 7, together with uncondensable gases and make-up ammonia and carbon dioxide, respectively, to reconstitute the ammonium carbonate required for the cation exchanger regeneration.

The bottoms from the distillation tower 6 are concentrated in evaporators 8 to supersaturate the carbonates of sodium and potassium for crystallization in crystallizer 9. The crystallized carbonates of sodium and potassium which may be substantially separated from each other in a multiple-step crystallization are separated in a centrifuge 10 from mother liquor. This respective final mother liquor from the carbonate crystallization is combined with the used decolorizer regenerant to precipitate the calcium ions as carbonates with the precipitated calcium carbonate removed by filter 11.

The filtrate from this step is concentrated in the multiple effect evaporator 12, prior to the treatment through crystallizer 13 for the crystallization of the chlorides of potassium and sodium which thereafter are separated in centrifuge 14 to be calcined at 400° C. in calcinator 15. The hot chlorides of the alkali metals are quenched in water to about 15% followed by filtration for the removal of carbonaceous material and prior to its re-use in the process of stripping the calcium ions from the primary cation exchanger 1.

The process according to FIG. 2 follows essentially the same pattern as outlined above for FIG. 1, with the following exception or additions: Following the decolorizer treatment as outlined above, the sugar juice is first taken through anion exchanger vessels 16 and 17 to exchange anionic sugar juice impurities against bicarbonate ions after which the sugar juice is subjected to evaporation in evaporator 5*a* to expel ammonium carbonates and bicarbonates, respectively. Sufficient magnesium oxide is added after all carbonates and bicarbonates are expelled to drive off all remaining ammonium ions from the sugar juice in evaporator 5*b*.

The treated sugar juice is handled in the conventional fashion of crystallization after the evaporation steps in evaporators 5*a* and 5*b*. The vapors from evaporators 5*a* and 5*b* are used to supply the energy required to operate distillation unit 6.

Anion exchangers 16 and 17 are regenerated after their exhaustion with respect to useful bicarbonate ions and following subsequent sweet-off procedure and counter-current to the established sugar juice flow with a saturated solution of alkali bicarbonates which is prepared by carbonating in absorber 7 the ammonium carbonate solution used for regenerating the cation exchanger 1 and 2.

Anion exchanger regeneration is carried out at a flow rate of 2–4 bedvolumes per hour and with a stoichiometric regenerant excess of 500–100% on anion exchanger capacity.

The used anion exchanger regenerant emanating from the anion exchanger vessels 16 and 17 is taken to distillation tower 6 to expel all unused ammonium bicarbonate. The vapors from distillation 6 are cooled and condensed to form a concentrate ammonium carbonate solution which is used to regenerate cation exchanger 1 and 2 counter-current to its respective sugar juice flow to the ammonium form. Uncondensable gases from distillation 6 are taken to absorber 7. The bottom products from distillation 6 are treated in evaporators 8 and crystallizer 9 for the recovery of alkali carbonates.

In the flow sheets of FIGS. 1 and 2 vessels A, B, C, F, G, H, I, J, L, and O are surge tanks; M represents a magnesium oxide feeder; and N and $N_1$ are condensors. Part 14*a* is a carbonate separator.

Specific examples follow:

EXAMPLE 1

Six liters of 55° brix, clarified sugarbeet juice with a purity of about 90% and containing about 0.277 gram equivalents of cations per liter of juice are passed through one liter of cation exchanger with sulfonic functionality in the ammonium form, at a flow rate of 2.5 bedvolumes per hour and at a temperature of 90° C. Thereby, nearly 100% of the sugarbeet juice cations are exchanged against ammonium ions.

Forty grams of active magnesium oxide are added to the sugarbeet juice thus treated, followed by an evaporation/distillation step to recover about 25 grams of ammonia.

We claim:

1. A process for the exchange of sugarbeet juice cations which comprises treating said juice with a cation exchanger in the ammonium form;

adding to the sugarbeet juice thus treated sufficient active magnesium oxide or magnesium hydroxide to liberate and recover through distillation the ammonia from said juice;

regenerating said cation exchanger with a stoichiometric excess of a concentrated solution of ammonium carbonate representing 150–500% equivalents on the capacity of said cation exchanger;

stripping excess ammonium carbonate from the cation regeneration waste in a stripper by introducing the ammonia bearing vapors from said juice distillation into the stripper;

condensing the vapors from said stripper followed by recarbonating said condensed vapors in a carbonator with $CO_2$ gas to reconstitute the concentrated ammonium carbonate solution to be used for said cation exchanger regeneration; and concentrating the bottom product from said stripper to recover said sugarbeet juice cations as their respective crystalline carbonates.

2. A process for the exchange of sugarbeet juice cations which comprises treating said juice with a cation exchanger in the ammonium form followed by an anion exchanger in the bicarbonate form;

evaporating and recovering the free bicarbonate from the sugarbeet juice thus treated;

adding magnesium oxide or magnesium hydroxide to the juice free of carbonates and/or bicarbonates respectively;

evaporating the resulting juice for the recovery of free ammonia therefrom;

regenerating said cation exchanger with a stoichiometric excess of a concentrated solution of ammonium carbonate;

converting the cation exchanger regeneration waste through carbonation with $CO_2$ in an absorber to a cation/$CO_2$ molar ration of $< 1.6$ and regenerating the exhausted anion exchanger with this resultant carbonated cation exchanger regeneration waste;

stripping excess ammonium carbonate/bicarbonate respectively from the anion regeneration waste in a stripper by introducing the ammonia- and ammonium carbonate-bearing vapors from the respective said juice evaporations into the stripper;

condensing and cooling the condensable vapors into a concentrated solution of ammonium carbonate;

using this concentrated ammonium carbonate solution for the regeneration of the exhausted cation exchanger and recycling the uncondensable gases from the stripper to said absorber and concentrating the bottom product from said stripper to recover said sugar-beet juice cation as their respective crystalline carbonates.

* * * * *